United States Patent [19]

Harman et al.

[11] 4,300,338

[45] Nov. 17, 1981

[54] METHOD OF PRODUCING COAXIAL CABLE

[75] Inventors: Robert K. Harman; Melvin Maki, both of Kanata, Canada

[73] Assignee: Control Data Canada, Ltd., Mississauga, Canada

[21] Appl. No.: 83,863

[22] Filed: Oct. 11, 1979

[30] Foreign Application Priority Data

Oct. 13, 1978 [CA] Canada ..... 313314

[51] Int. Cl.[3] ..... H01Q 13/22

[52] U.S. Cl. ..... 57/3; 333/237

[58] Field of Search ..... 57/3, 6, 9, 13, 15, 57/31, 32, 215, 259, 260, 235; 333/237

[56] References Cited

U.S. PATENT DOCUMENTS 3,486,317 12/1969 Grawey et al. ..... 57/3
3,756,004 9/1973 Gore ..... 57/3 X
3,870,977 3/1975 Peoples et al. ..... 333/237
3,949,329 4/1976 Martin ..... 333/237
3,975,700 8/1976 Halstead ..... 333/237

*Primary Examiner*—Donald Watkins
*Attorney, Agent, or Firm*—Fleit & Jacobson

[57] ABSTRACT

A method of manufacturing leaky coaxial cables having an array of apertures in the conductive outer layer. The total area of the apertures is a predetermined fraction of the surface area of the cable. A pair of strip conductors of particular widths are selected and wound around the inner conductor and dielectric at predetermined pitch angles. This provides apertures having a total area which is a predetermined fraction of the surface area of the cable, a predetermined shape and being of a predetermined number per unit length. By varying the pitch angle during winding the distribution of apertures and hence the coupling of the cable can be varied. By testing short sections of cables of different geometry a coupling function and an attenuation function can be calculated to provide data for winding cables with desired characteristics.

5 Claims, 6 Drawing Figures

Aperture Shape
w/c' =
0.1
0.2
0.3
0.4
0.5
0.6
0.7
0.8
0.9
PERCENTAGE APERTURE AREA
0
5
10
15
20
25
30
0
30
60
90 θ degrees
0
1
2
4
8
16
NUMBER OF APERTURES PER DISTANCE c

METHOD OF PRODUCING COAXIAL CABLE

This invention relates to the manufacture of leaky coaxial cables also known as radiating cables.

Such cables are formed with apertures in the outer conductive layer. These apertures provide a leakage field around the cable, which field can be used either for communication or for object detection. This latter application is taught in U.S. Pat. No. 4,091,367 issued May 23, 1978 in the name of Robert K. Harman and the corresponding Canadian Pat. No. 1,014,245 issued July 19, 1977. These patents teach the desirability of providing a distribution of apertures or aperture size varying along the length of a cable to provide an increased leakage field to compensate for cable attenuation losses increasing with distance. Cables of different coupling properties are also required for other applications, such as lead-in sections. Hitherto, it has not been easy to manufacture coaxial cables providing a variable degree of coupling along their length. It is known to splice cable segments of different coupling characteristics in order to provide coupling but this results in discontinuities in signal strength and introduces spurious reflection points.

The present invention relates to a method of manufacturing leaky coaxial cables with an array of apertures each of a predetermined shape, and having a total area a predetermined fraction of the area of the outer surface of the cable. The method can produce cables having a predetermined variable distribution of apertures along their length and hence, a predetermined variable coupling characteristic along their length.

Specifically, the invention relates to a method of manufacturing a leaky coaxial cable comprising the steps of: providing a core having an inner conductor surrounded by a dielectric layer and winding at least two conductive tapes therearound. The tape widths and pitch angles are selected to provide apertures having an exposed area which is a predetermined fraction of the surface area of the cable. The word "tape" is intended to encompass braided conductors and flat assemblies of wires as well as solid conductors. The dielectric layer may, of course, be formed by an air space.

The invention will become apparent from the following description taken in conjunction with the accompanying drawings in which.

DESCRIPTION OF THE PREFERRED EMBODIMENT

Figure 1:
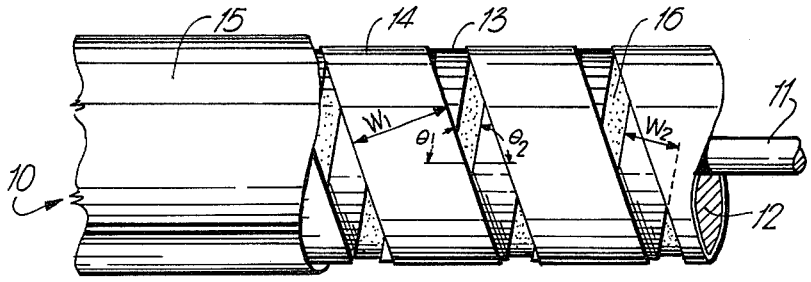
FIG. 1 is a diagrammatic view of a leaky coaxial cable constructed by winding tapes of different widths and at different pitch angles.

FIG. 1 shows the type of leaky coaxial cable 10 produced in accordance with the present invention. A single central conductor 11, either solid or stranded is surrounded by a dielectric material 12 selected to provide a desired velocity of propagation within the cable. An outer conductive layer is formed by two conductive tapes 13 and 14. Tapes 13 and 14 can be either braided or unwoven depending on the desired mechanical and electrical properties. Although the tape is generally flat, some roughening or corrugation of the surface may be desirable to provide improved mechanical properties. An outer non-conductive sheath 15 covers the cable.

The arrangement of tapes 13 and 14 is such as to create apertures 16 which expose areas of the dielectric 12 through which electrical energy can be coupled from the cable. The coupling characteristic of the cable is defined primarily by the fraction of dielectric surface area exposed by apertures 16, although the density of apertures along the cable length and their shape are also relevant factors. If tapes 14 and 13 are of widths $w_1$ and $w_2$ and helically wound at pitch angles $\theta_1$ and $\theta_2$, all as shown in FIG. 1, then the percentage exposed area (A) of the outer conductor is given by:

$$A = \left(1 - \frac{w_1/c}{\cos\theta_1}\right)\left(1 - \frac{w_2/c}{\cos\theta_2}\right)$$

where c is the circumference of the cable at the outer conductive layer and the thicknesses of the tapes is negligible relative to their width. The ratio of the outer conductive layer diameter to the inner conductor diameter is usually determined by the required cable impedance. Then, from dimensionless parameters $w_1/c$ and $w_2/c$ the widths of tapes 13 and 14 can be determined and tape pitch angles $\theta_1$ and $\theta_2$ selected. By modifying tape pitch angles $\theta_1$ and $\theta_2$ when wrapping the cable the fraction of surface area exposed can be varied along the cable length thus varying the coupling in a predetermined manner as a function of position along the cable.

Figure 2:
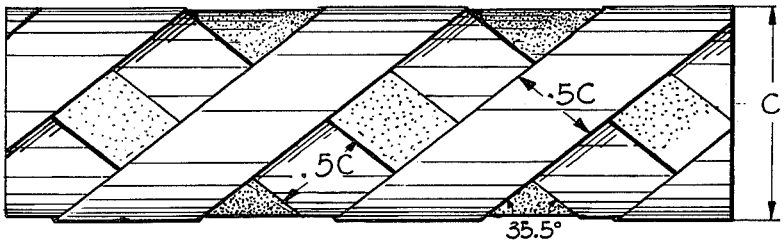
FIG. 2 shows the outer conductive surface of a cable wound with two tapes of equal widths and at equal pitch angles.
Figure 5:
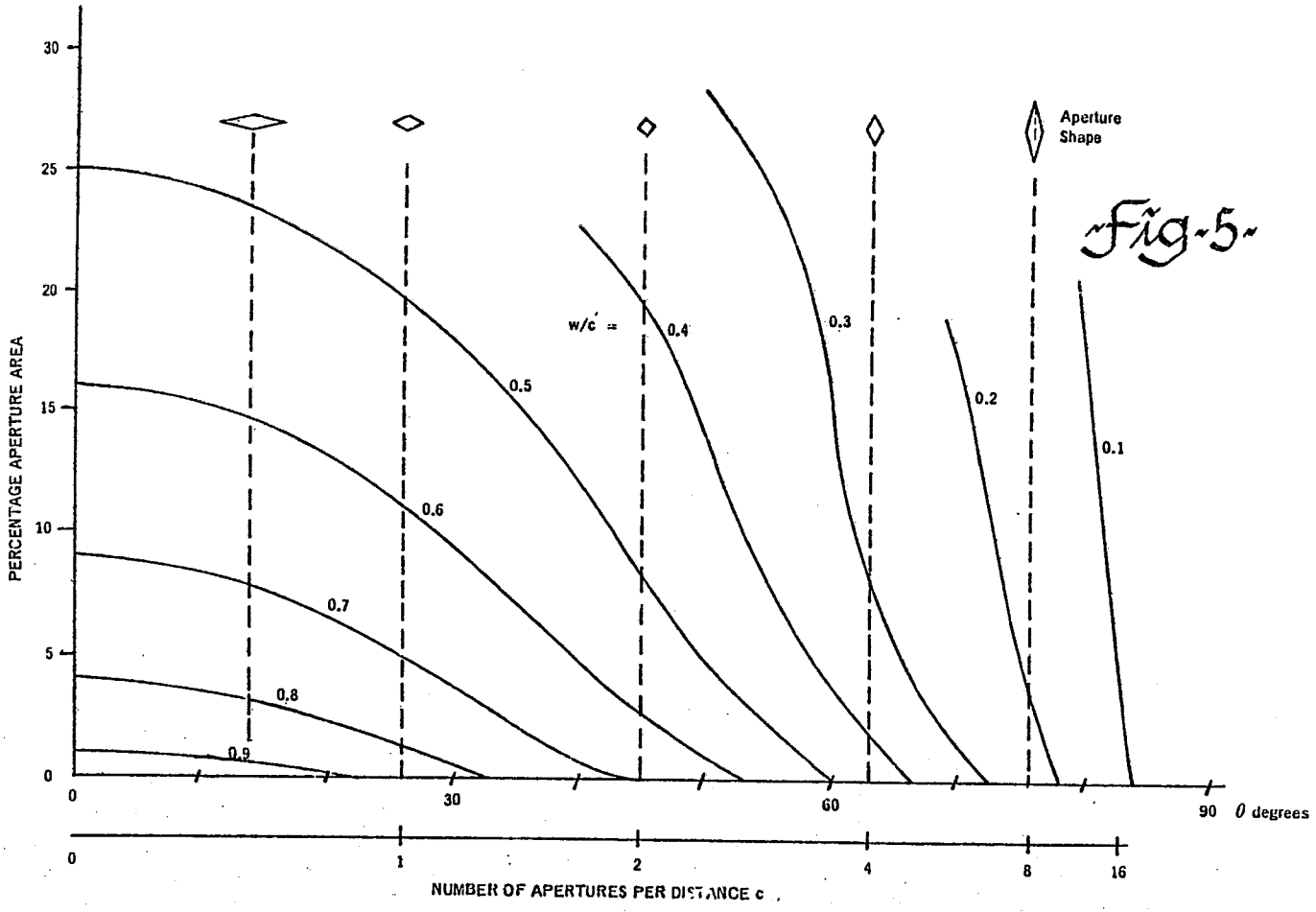
FIGS. 5 and 6 show graphs of aperture shape, density and exposed area as a function of tape width and pitch angle.

FIG. 2 shows the outer conductive layer of a cable in which the conductive tapes are of equal width and wound at equal pitch angles. The particular configuration of FIG. 2 produces 15% exposed area with $w/c=0.5$ and hence $\theta=35.5°$. The graph of FIG. 5 gives the distribution of exposed area for a complete range of normalized tape widths w/c and pitch angles $\theta$ for this class of cable. Following along the curve $w/c=0.5$ it can be seen that the exposed area can be varied from 25% at 0° pitch to zero at 60° pitch. FIG. 5 also indicates the variations in diamond shape of the exposed areas and the number of discrete apertures per length c along the cable.

Figure 3:
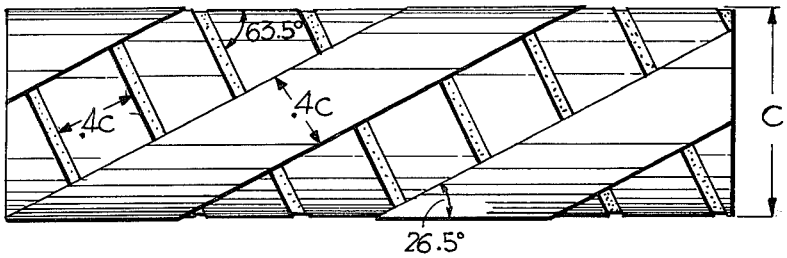
FIG. 3 shows the outer conductive surface of a cable wound with two tapes of equal width and at pitch angles adding to 90°.
Figure 6:
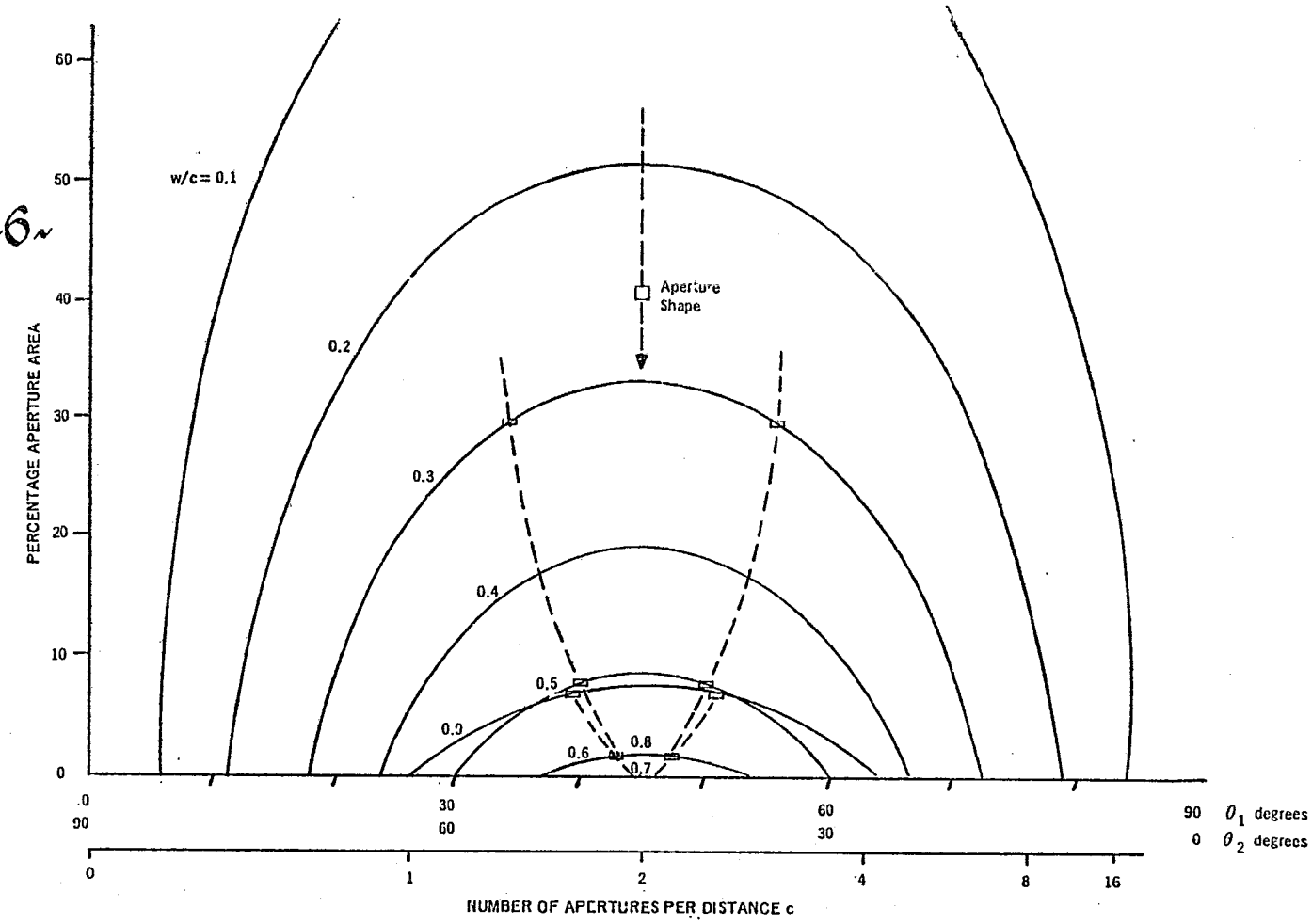

FIG. 3 shows the outer conductive surface of a cable in which the pitch angles add to 90°, which results in the production of exposed areas of rectangular shape. The particular configuration of FIG. 3 produces 6% exposed area with $w/c=0.4$, $\theta_1=26.5°$ and $\theta_2=63.5°$. FIG. 6 is a graph similar to that of FIG. 5 showing the relationship between exposed area and the various parameters. It will be noted that for $w/c=0.4$ the exposed area could be varied in the range 0–19% along the length by controlling pitch angle.

Figure 4:
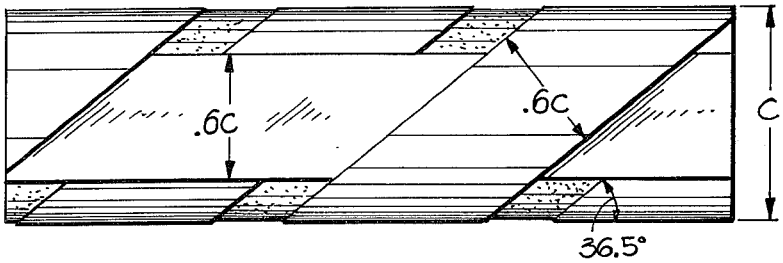
FIG. 4 shows the outer conductive surface of a cable in which one tape runs axially.

FIG. 4 illustrates an extreme condition where one of the tapes runs axially and the other is wound helically. The particular configuration of FIG. 4 produces 10% exposed area with $w/c=0.6$ and $\theta=36.5°$. For this tape width value, variation in pitch angle $\theta$ can provide a variation of exposed area from 0–16%.

The method of this invention is practised in conjunction with the following design steps. Installed cable performance, defined in terms of coupling and attenuation, is a function of the geometry of the cable. This has been both difficult to correlate using field measurements and the performance results difficult to use in cable design. By means of an experimental procedure known as a cavity test it has become possible to accurately measure cable coupling both in a controlled environment and using short cable lengths, rather than using long lengths buried in the field. Several cable samples of the proposed design, each of different geometric factors, are constructed. These are tested using the cavity procedure, and their attenuation also measured. The correlation of test results demonstrates the relationship between the geometric parameters and cable performance. Use of these results allows the formulation of an optimal design, using the method of this invention and tailored to the particular installation.

The design procedure is as follows. Using measurements of cable coupling and attenuation from a number of sample cables all of the proposed design but each of different specified geometry as far as tape width and angle is concerned, correlation equations are fitted to the experimental data. The form of these equations are:

$$\text{Coupling } C=f(\theta_1, \theta_2, w_1, w_2, c)dB$$

$$\text{Attenuation } \alpha=g(\theta_1, \theta_2, w_1, w_2, c)dB/100\ m.$$

where the functions f and g are determined from the correlation of experimental results of a sufficient number of tests on different cable designs. For example, using the test results of measured coupling for 8 different sample cables of the proposed design, a correlation equation has been determined to be:

$$C = -7.624\, N^{-.4551}\left(1-\frac{w_1/c}{\cos\theta_1}\right)^{-.080}\left(1-\frac{w_2/c}{\cos\theta_2}\right)^{-1.390} dB$$

where N, the number of apertures per circumferential distance c, is defined as $$N=\tan\theta_1+\tan\theta_2$$

and $w_1$ and $w_2$ are arranged in order so that the quantity $1-(w_1/c)/\cos\theta_1$ is equal to or greater than $1-(w_2/c)/\cos\theta_2$. A similar type of correlation equation is determined from the results of attenuation tests. The two equations are then used to design cables; determining their tape widths and pitch angles, to produce a desired coupling and attenuation.

In order to grade cables to maintain sensitivity along their length, it is necessary to utilize the capability of the design to vary the cable geometry along the length. For example, to maintain a constant field intensity along the length of a cable for the case where the two tapes are of an equal and predetermined width, and the two pitch angles are equal but variable, it has been found that the following relation must be satisfied by the pitch angle:

$$\frac{d\theta}{dx}=\frac{\alpha(\theta[x])}{dC/d\theta}$$

Here x is the cable length parameter. This differential equation, with suitable boundary conditions, when solved for the pitch angle $\theta$ in terms of x, provides the required pitch angle along the cable length as required for grading. The necessary functions $\alpha(\theta)$, $C(\theta)$ in this equation are available from the reduction of the earlier described correlations, which were derived from cable test results.

The embodiments of the invention in which an exclusive property or privilege is claimed are defined as follows:

1. A method of manufacturing a leaky coaxial cable, comprising the steps of:

providing a core having an inner conductor surrounded by a dielectric layer, selecting at least two conductive tapes having tape widths and pitch angles which provide apertures having a total area which is a predetermined fraction of the surface area of the cable, and apertures also having a predetermined shape and being of a predetermined number per defined length, and winding said at least two conductive tapes around said core having said inner conductor surrounded by said dielectric layer.

2. A method as recited in claim 1, including the further step of varying the pitch angle of at least one of said at least two conductive tapes so as to vary the number of apertures per unit length and said predetermined fraction.

3. A method of manufacturing a leaky coaxial cable comprising the steps of:

providing a core having an inner conductor surrounded by a dielectric layer, and winding at least two conductive tapes therearound, the tape widths and pitch angles being selected to provide apertures having a total area which is a predetermined fraction of the surface area of the cable, having a predetermined shape and being of a predetermined number per defined length;

said method further including the steps of constructing short lengths of cables of varying geometry, testing the coupling and attenuation of said short lengths to determine a coupling function C and an attenuation function $\alpha$ where:

$$C=f(\theta_1, \theta_2, w_1, w_2, c)$$

$$\alpha=g(\theta_1, \theta_2, w_1, w_2, c)$$

where $\theta_1$ and $\theta_2$ are tape pitch angles, $w_1$ and $w_2$ are tape widths, and c is the cable circumference, and determining the tape width and pitch angles to give the desired cable characteristics.

4. A method as set out in claim 3, wherein the pitch angles are varied along the cable length.

5. A method as set out in claim 4, wherein the pitch angles are equal and of value $\theta$ and vary in accordance with the relationship:

$$\frac{d\theta}{dx}=\frac{\alpha(\theta[x])}{dC/d\theta}$$

where x is distance along the cable.

* * * * *